US005406823A

United States Patent [19]

Yong et al.

[11] Patent Number: 5,406,823

[45] Date of Patent: Apr. 18, 1995

[54] METHOD OF PRODUCING A MAIN FRAME FOR A SHIPPING CONTAINER

[75] Inventors: Kin S. Yong; Fa S. Hsu, both of Singapore, Singapore

[73] Assignee: Nam Lee Industries (PTE) Ltd., Singapore, Singapore

[21] Appl. No.: 960,184

[22] Filed: Oct. 9, 1992

Related U.S. Application Data

[63] Continuation of Ser. No. 643,916, Jan. 18, 1991, abandoned.

[51] Int. Cl.[6] ..... B21D 28/32; B21D 22/26

[52] U.S. Cl. ..... 72/334; 72/347; 72/348; 72/379.4

[58] Field of Search ..... 72/347–349, 72/334, 379.4, 379.2; 62/263, DIG. 16, 239; 312/236, 242

[56] References Cited

U.S. PATENT DOCUMENTS

| | | | |
|---|---|---|---|
| Re. 21,997 | 1/1942 | Stanitz | 72/348 |
| 1,635,311 | 7/1927 | Corrigan | 72/348 |
| 2,305,866 | 12/1942 | Graf | 72/350 |
| 2,506,864 | 5/1950 | Ferguson | 312/246 |
| 3,197,996 | 8/1965 | Zeder | 72/348 |
| 3,263,637 | 8/1966 | Cox | 72/348 |
| 3,440,988 | 4/1969 | Bremer | 72/348 |
| 3,918,377 | 11/1975 | Herbold | 72/350 |
| 4,309,888 | 1/1982 | Miller | 72/334 |
| 4,608,834 | 9/1986 | Rummel | 62/DIG. 16 |
| 4,920,764 | 5/1990 | Martin | 62/DIG. 16 |

FOREIGN PATENT DOCUMENTS

| | | | |
|---|---|---|---|
| 15218 | 9/1980 | European Pat. Off. | 72/347 |
| 0173184 | 5/1985 | European Pat. Off. . | |
| 0165133 | 8/1985 | European Pat. Off. . | |
| 47223 | 4/1981 | Japan | 72/349 |
| 152323 | 9/1982 | Japan | 72/347 |
| 168730 | 10/1982 | Japan | 72/347 |
| 168442 | 10/1983 | Japan | 72/347 |
| 196125 | 11/1983 | Japan | 72/347 |
| 120325 | 7/1984 | Japan | 72/379.4 |
| 143726 | 6/1989 | Japan | 72/348 |
| 1209930 | 10/1970 | United Kingdom . | |
| 1438207 | 6/1976 | United Kingdom . | |
| 1052669 | 12/1976 | United Kingdom . | |
| 2116099 | 9/1983 | United Kingdom . | |
| 2151527 | 7/1985 | United Kingdom . | |
| 597469 | 3/1978 | U.S.S.R. | 72/347 |
| 747577 | 7/1980 | U.S.S.R. | 72/350 |
| 1530301 | 12/1989 | U.S.S.R. | 72/350 |

*Primary Examiner*—Daniel C. Crane
*Attorney, Agent, or Firm*—Kenyon & Kenyon

[57] ABSTRACT

Shipping container carrying cargoes requiring temperature control and/or ventilation require a main frame capable of housing a refrigeration unit. Hitherto, main frames have been constructed by welding the component parts together which is extremely time consuming. The present invention provides a method for producing a main frame in which a recessed portion for housing the refrigeration unit is deep drawn while a force is simultaneously applied to maintain a substantially constant thickness of the main frame.

4 Claims, 6 Drawing Sheets

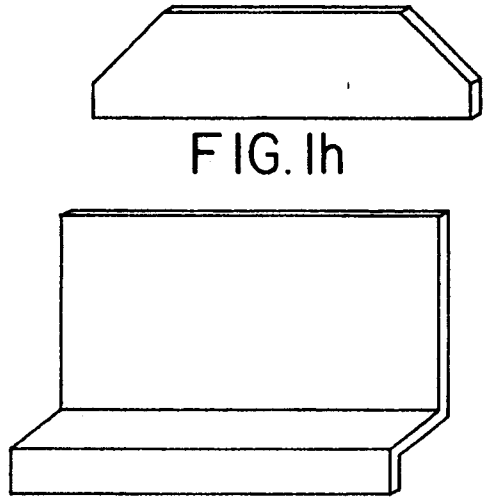
FIG. 1h
FIG. 1g
(PRIOR ART)
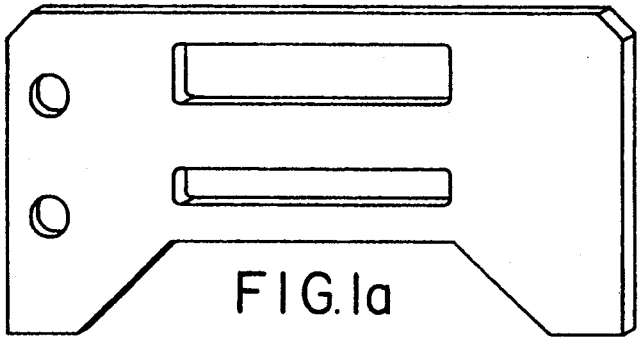
FIG. 1a
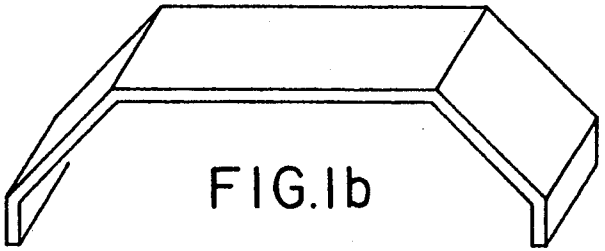
FIG. 1b
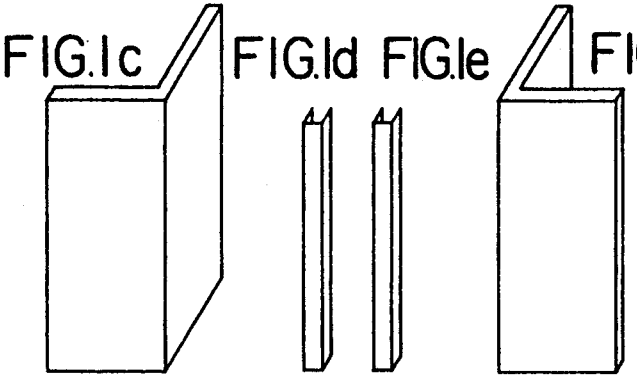
FIG. 1c FIG. 1d FIG. 1e FIG. 1f

METHOD OF PRODUCING A MAIN FRAME FOR A SHIPPING CONTAINER

This is a continuation application of U.S. Ser. No. 07/643,916, filed Jan. 18, 1991 now abandoned.

FIELD OF THE INVENTION

The present invention relates to a method for producing a main frame for a shipping container and products thereof, particularly, one-piece main frames for shipping containers adapted for attachment to refrigeration means.

BACKGROUND OF THE INVENTION

Shipping containers are used for transporting many different types of cargoes. Cargoes requiring temperature control and/or ventilation may require, for example, a refrigeration unit comprising a fan motor, condenser coils, liquid receive, compressor, contactor panel and a micro-computer controller coupled to the shipping container. Conventional shipping containers have housed such refrigeration units in the container's main frame. The main frame may be secured by huckbolts to an open end of the refrigeration unit and sealed with silicone.

A conventional main frame is shown in FIGS. 1 and 2. The profile of this main frame is first punched from sheet metal, then further profiled where necessary and then the profiled sheets are welded together to create the final main frame profile required for housing a refrigeration unit. Producing a main frame in this manner is expensive and time consuming.

OBJECTS AND SUMMARY OF THE INVENTION

An object of the present invention is to provide an efficient and economical method for producing a one-piece main frame for a shipping container.

The present invention provides a method for forming a sheet including an integral having substantially the same thickness as the sheet comprising the steps of applying a compressive force directed along the plane of the sheet while simultaneously applying a force directed substantially perpendicular to the plane of the sheet to form the recess.

The present invention provides a method for producing a main frame for a shipping container having an integral recessed portion, preferrably formed from a single sheet; comprising the steps of applying a force in a direction of the major surface of said sheet and simultaneously deep drawing the pressed sheet in a direction substantially perpendicular to said sheet to form said recessed portion.

BRIEF DESCRIPTION OF THE DRAWINGS

By way of example only, a preferred embodiment of the present invention will now be described with reference to the accompanying drawings, of which:

FIGS. 1*a* to 1*h* are schematic diagrams of the components of a main frame constructed in accordance with the prior art;

DETAILED DESCRIPTION OF THE INVENTION

Figure 5A:
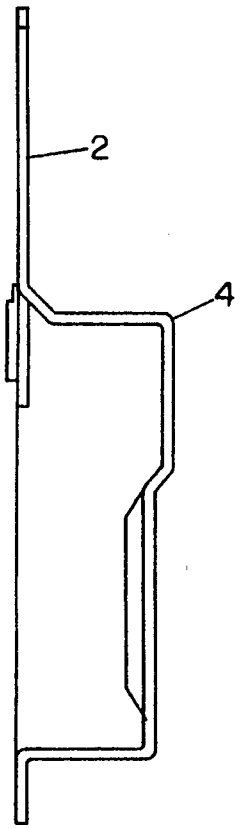
FIGS. 5 and 5A are a planar view and cross-section of a main frame produced in accordance with the invention.
Figure 5:
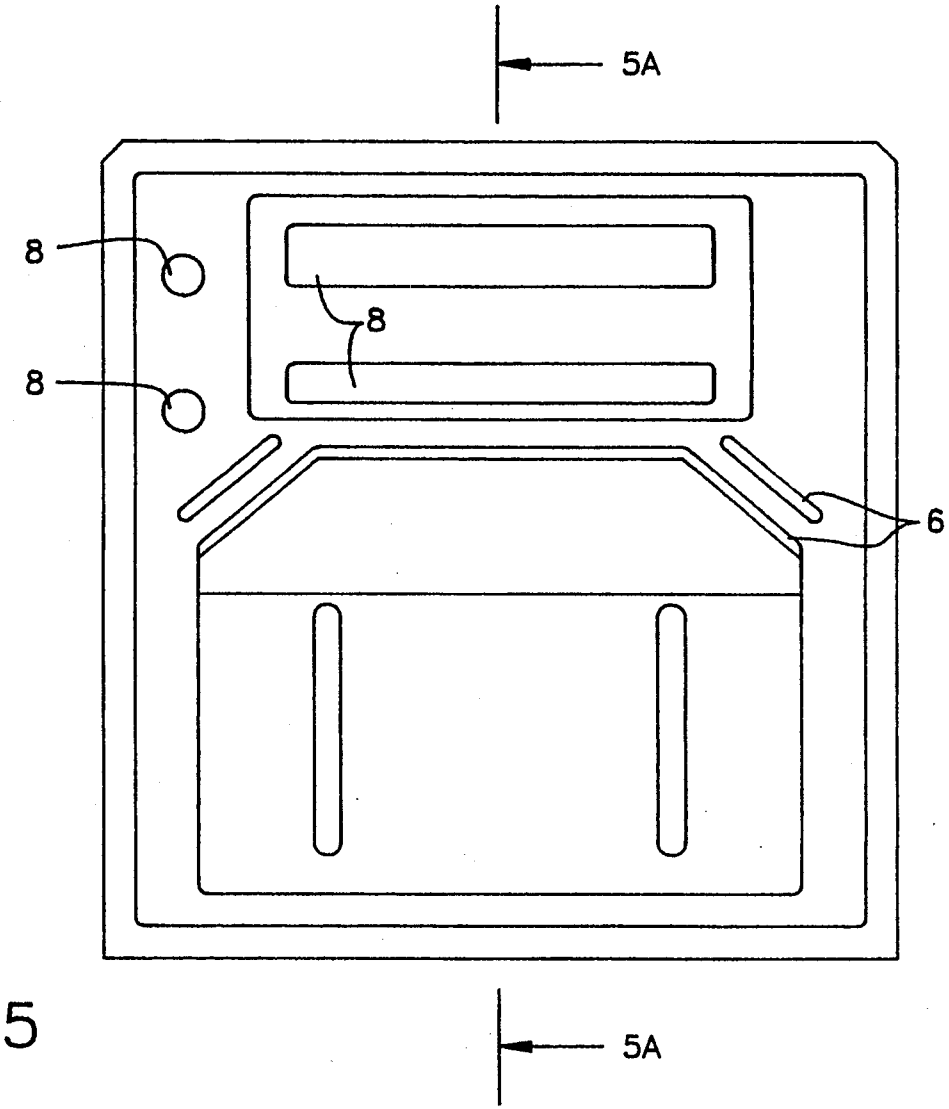

The structural features of a main frame produced according to the described embodiment shown in FIGS. 5 and 5A comprise a side (2) of the main frame which may be secured by huckbolts to an open end of a refrigeration unit (not shown) and sealed with silicone to form an enclosed space. The side (2) includes a recessed portion (4), a number of profiles (6) and holes (8).

Figure 2A:
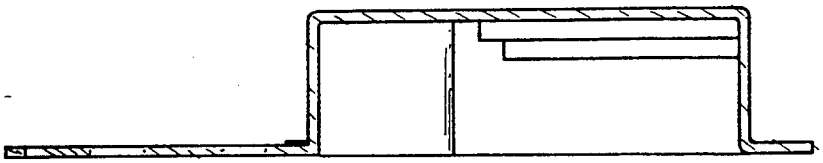
FIG. 2A (PRIOR ART)
FIGS. 2 and 2A are a schematic planar view and cross-section of a main frame assembled with the components shown in FIGS. 1*a*–1*h;*
Figure 2:
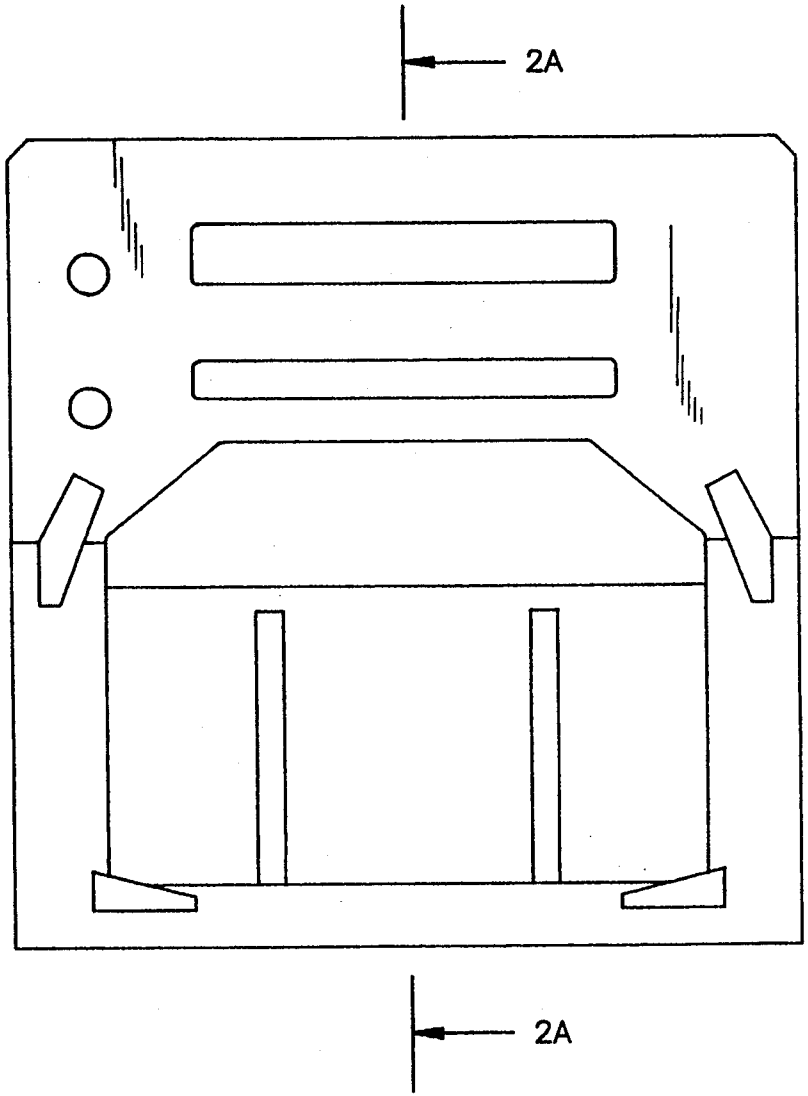
FIG. 2 (PRIOR ART)
Figure 3A:
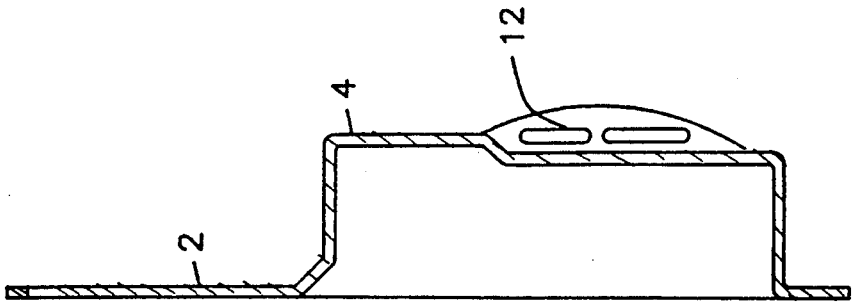
FIGS. 3 and 3A are a schematic planar view and cross-section of a main frame produced accordance with the invention at a first step of production.
Figure 3:
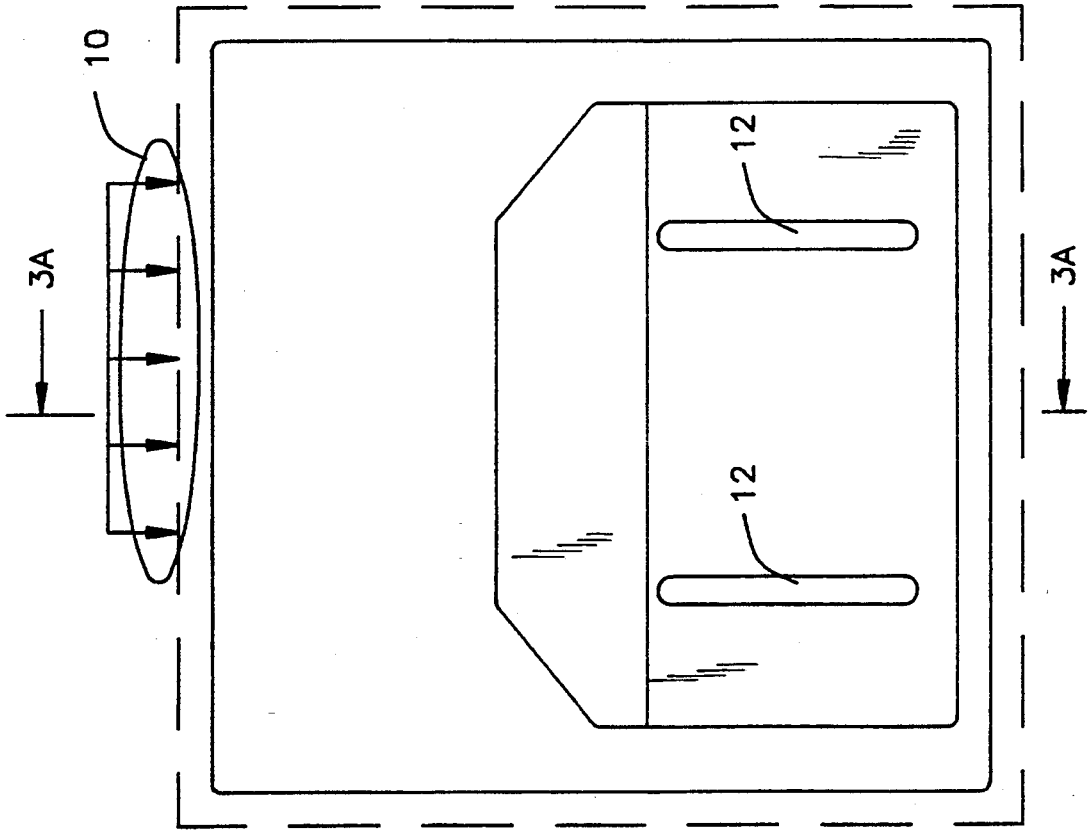

The first stage of production is illustrated in FIGS. 3 and 3A. Recess (4) is initially deep drawn by applying force in a direction substantially perpendicular to the plane of the side (2). Deep drawing is a process known in the art for forming shapes having large depth to diameter ratios, usually from sheet or strip metal by effecting considerable plastic distortion. A hydraulic device (10) applies a force in the plane of side (2) while the recess (4) is being deep drawn in order to avoid cracks in sheet materials having low ductility. The force applied by the hydraulic device (10) enables the sheet material of side (2) to flow evenly thereby maintaining a specified thickness of the main frame.

Figure 4A:
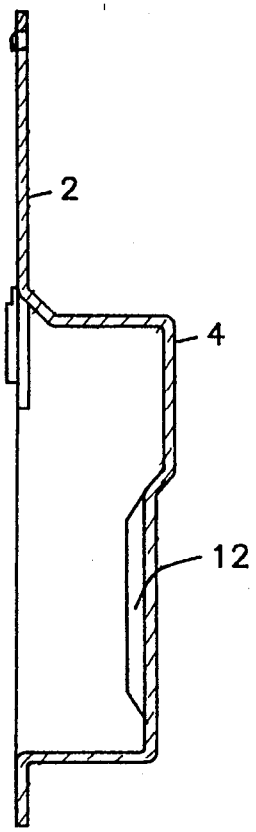
FIGS. 4 and 4A are a schematic planar view and cross-section of a main frame produced in accordance with the invention at a second step of production.
Figure 4:
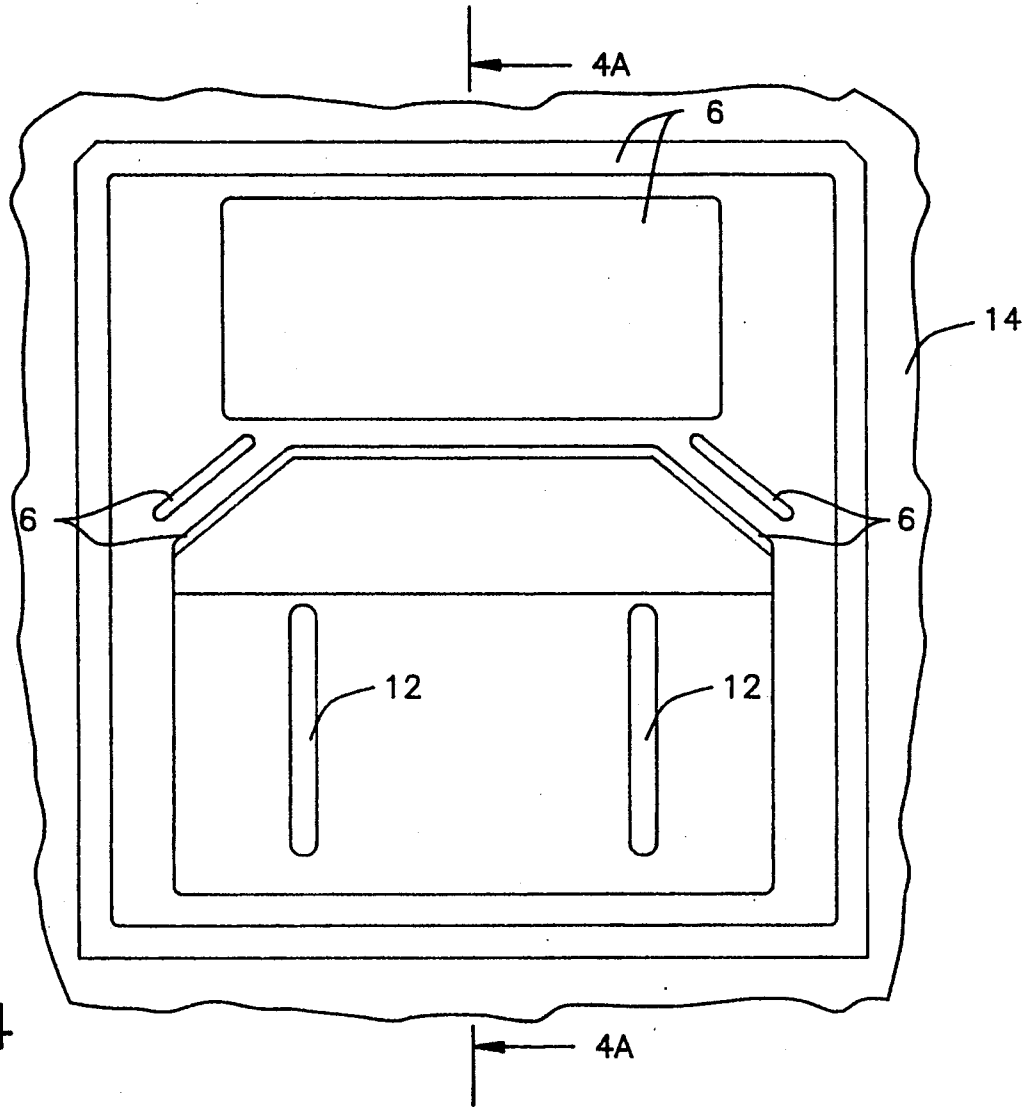

In FIGS. 4 and 4A the sècond stage is illustrated in which the profiles (12) may be deep drawn in a direction perpendicular to the plane of side (2) but opposite to that employed to deep draw recess (4). Additional profiles (6) may also be deep drawn at this stage.

In stage three of the production shown in FIGS. 5 and 5A holes (8) may be blanked and any excess edge material (14) may be sheared off.

Side (2) may then be fixed to a refrigeration usually by securing with huckbolts and then sealed with silicon. Preferably the main frame is made from aluminum sheet but other ductile metals may be used.

Figure 6:
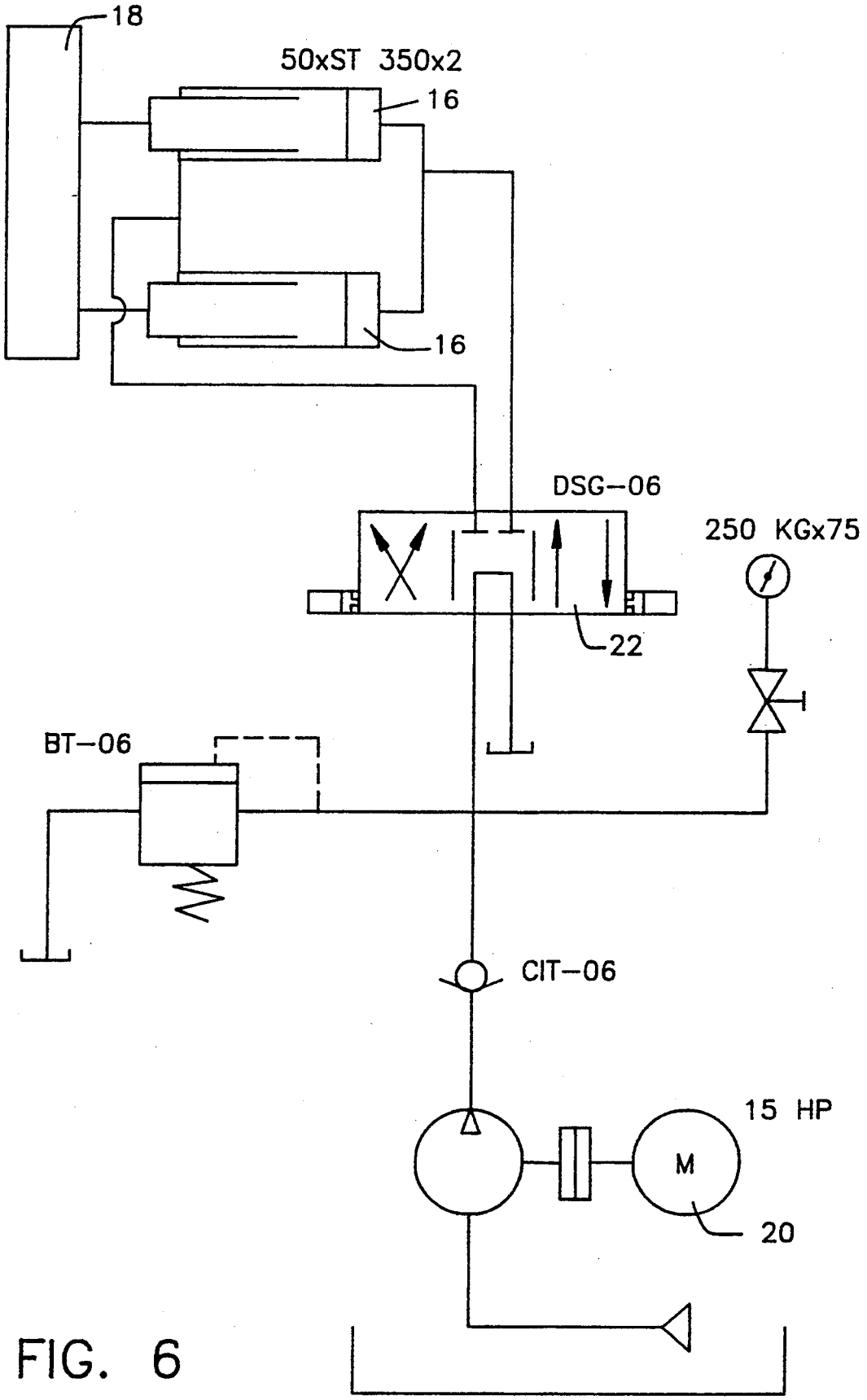
FIG. 6 is a schematic flow diagram of an hydraulic device used to practice the invention.

Preferably, the deep drawing stages are executed by a conventional 2000 ton hydraulic deep drawing machine equipped with at least two pairs of dies. Preferably, the hydraulic device (10) can apply compressive forces in the order of 50 tons. The hydraulic device as shown in FIG. 6, comprises two hydraulic cylinders (16) coupled to a plate (18) for applying a deep drawing uniform force over the side (2). The hydraulic cylinders (16) are activated by a motor (20) via a 2-way hydraulic valve (22).

The present invention thus provides a main frame quickly and efficiently and even though the recess (4) is off center, still enables the side (2) to maintain a substantially constant thickness.

The foregoing description of the invention is by way of example only and it will be appreciated by those skilled in the art that modifications may be made to the present invention without departing from the spirit and scope thereof.

What is claimed:

1. A method for making a main frame for a shipping container of substantially uniform thickness and having a single integral recess from a single rectangular sheet of metal having a center line defining a first side and second side comprising the steps of:

a) applying a compressive force directed along a plane defined by the sheet at the first side of the sheet; and b) simultaneously applying a deep drawing force directed substantially perpendicular to the plane of the sheet thereby forming the single recess, said deep drawing force applied separately from said compressive force, at the second side of the sheet and off-center relative to said center line so that only the single deep drawn recess is formed in the sheet; and c) adapting said main frame for attachment to said shipping container and further adapting said main frame to house a refrigeration unit to refrigerate said shipping container.

2. The method according to claim 1, wherein the resultant compressive force on the sheet is not equal to zero so that the recess can be formed off-center in the sheet while substantially uniform thickness is maintained.

3. The method according to claim 1 further comprising the step of forming additional profiles in the sheet by deep drawing in a direction opposite to the direction in which the recess was drawn.

4. The method according to claim 3 further comprising the step of blanking the sheet to provide at least one hole.

* * * * *